US009131753B2

(12) United States Patent
Chien et al.

(10) Patent No.: US 9,131,753 B2
(45) Date of Patent: Sep. 15, 2015

(54) WALKING STICK HANDLE STRUCTURE

(71) Applicants: Li-Sheng Chien, Taipei (TW); Chien-Chang Ho, Taipei (TW)

(72) Inventors: Li-Sheng Chien, Taipei (TW); Chien-Chang Ho, Taipei (TW)

( * ) Notice: Subject to any disclaimer, the term of this patent is extended or adjusted under 35 U.S.C. 154(b) by 112 days.

(21) Appl. No.: 14/016,533

(22) Filed: Sep. 3, 2013

(65) Prior Publication Data

US 2015/0062874 A1 Mar. 5, 2015

(51) Int. Cl.
*F21V 19/00* (2006.01)
*A45B 3/04* (2006.01)
*A45B 9/02* (2006.01)

(52) U.S. Cl.
CPC .... *A45B 3/04* (2013.01); *A45B 9/02* (2013.01)

(58) Field of Classification Search
None
See application file for complete search history.

(56) References Cited

U.S. PATENT DOCUMENTS 4,671,478 A * 6/1987 Schoenig et al. ..... 248/124.1
4,860,179 A * 8/1989 Mui et al. ..... 362/102
5,582,196 A * 12/1996 Hae et al. ..... 135/65
5,588,735 A * 12/1996 Harada ..... 362/102
7,455,417 B1 * 11/2008 Fan ..... 362/102
2002/0163811 A1 * 11/2002 Sipala ..... 362/398
2002/0189657 A1 * 12/2002 Yuan ..... 135/65
2006/0072328 A1 * 4/2006 Chan ..... 362/382
2006/0090783 A1 * 5/2006 King-Fai ..... 135/67
2010/0043853 A1 * 2/2010 Wu ..... 135/66
2010/0147342 A1 * 6/2010 Navarro ..... 135/66
2010/0154851 A1 * 6/2010 Gorey et al. ..... 135/66
2012/0080064 A1 * 4/2012 Gorey et al. ..... 135/66

* cited by examiner

*Primary Examiner* — Britt D Hanley
(74) *Attorney, Agent, or Firm* — Schmeiser, Olsen & Watts, LLP

(57) ABSTRACT

A walking stick handle structure includes a handle body, a light-emitting module, and a power module. The handle body has two casings coupled together to form an opening. The casings each have an inner wall disposed thereon with a plurality of bumps corresponding in position to the opening. The light-emitting module has a first light-emitting portion and a connection portion. The connection portion is disposed in the opening and pivotally connected to the casings to enable the connection portion to rotate relative to the handle body. The connection portion has a curved surface and two lateral surfaces. The lateral surfaces each have recesses aligned in an arcuate pattern. The bumps are engaged with and fixed to the recesses, respectively, by an angle of rotation of the connection portion relative to the handle body. The power module is disposed in the handle body and electrically connected to the first light-emitting portion.

4 Claims, 6 Drawing Sheets

WALKING STICK HANDLE STRUCTURE

FIELD OF TECHNOLOGY

The present invention relates to walking stick handle structures, and more particularly, to a walking stick handle structure with a light-emitting module characterized by an adjustable illumination angle.

BACKGROUND

In general, walking sticks assist physically challenged persons and hikers in walking by bearing a portion of the body weight and thus reducing the burden of the lower limbs. To provide illumination in the dark or at an unilluminated corner, a light-emitting module is installed at the front end of a walking stick handle of a conventional walking stick and adapted to illuminate and ensure that the user can walk safely.

However, the light-emitting module of the conventional walking stick handle is fixed to the walking stick handle by a specific angle in a manner that a light ray emitted from the light-emitting module can only propagate forward. If the user wants to illuminate the ground immediately in front of her or him, s/he has to tilt the conventional walking stick by an angle in order for the light ray emitted from the light-emitting module to fall on the ground; however, in doing so, the conventional walking stick is functioning no more. To remedy the above drawback, the user illuminates the ground first and then restores the conventional walking stick to its vertical functioning position before starting to walk with the walking stick. Being incapable of continuous illumination, the conventional walking stick not only lacks ease of use but also fails to ensure user safety.

Accordingly, it is imperative to invent a walking stick handle structure which improves on the conventional walking stick in terms of illumination.

SUMMARY

It is an objective of the present invention to provide a walking stick handle structure capable of adjusting the direction in which a light ray emitted from a light-emitting module of the walking stick handle structure propagates.

In order to achieve the above and other objectives, the present invention provides a walking stick handle structure comprising a handle body, a light-emitting module, and a power module. The handle body comprises two casings coupled together to form an opening at an end of the handle body, the casings each having an inner wall disposed thereon with a plurality of bumps corresponding in position to the opening. The light-emitting module comprises a first light-emitting portion and a connection portion. The connection portion is disposed in the opening and pivotally connected to the casings to enable the connection portion to rotate relative to the handle body. The connection portion has a curved surface and two lateral surfaces. The lateral surfaces each have recesses aligned in an arcuate pattern. The bumps are engaged with and fixed to the recesses, respectively, by an angle of rotation of the connection portion relative to the handle body. The power module is disposed in the handle body and electrically connected to the first light-emitting portion.

As regards the walking stick handle structure, the recesses are disposed at upper and lower portions of each of the lateral surfaces, and the bumps are disposed at upper and lower portions of an inner wall of each of the casings in the opening.

As regards the walking stick handle structure, five said recesses are disposed at both the upper portion and the lower portion of each of the lateral surfaces, and two said bumps are disposed at both the upper portion and the lower portion of the inner wall of each of the casings in the opening and engaged with and fixed to any two adjacent ones of the recesses upon rotation of the connection portion relative to the handle body.

As regards the walking stick handle structure, each of the lateral surfaces of the connection portion has a round hole, and a post is disposed on the inner wall of each of the casings in the opening and inserted into the round hole.

As regards the walking stick handle structure, a first tilted surface is disposed at a junction of the first light-emitting portion and the connection portion and corresponds in position to a lower portion of each of the lateral surfaces.

As regards the walking stick handle structure, a second tilted surface is disposed at the opening and corresponds in position to a lower portion of the opening.

As regards the walking stick handle structure, the casings are equipped with a buzzer electrically connected to the power module.

As regards the walking stick handle structure, the casings are equipped with a second light-emitting portion electrically connected to the power module.

Accordingly, the present invention provides a walking stick handle structure characterized in that: a light-emitting module is pivotally coupled to a handle body by means of a connection portion; the light-emitting module can be rotated relative to the handle body; and recesses on the connection portion and bumps on the handle body are engaged with each other, respectively, to fix the angle of rotation of the light-emitting module relative to the handle body, so as to enable the user to adjust the direction in which a light ray emitted from the light-emitting module propagates and thus provide continuous illumination, thereby enhancing user safety.

BRIEF DESCRIPTION

Objectives, features, and advantages of the present invention are hereunder illustrated with specific embodiments in conjunction with the accompanying drawings, in which.

DETAILED DESCRIPTION

Figure 1:
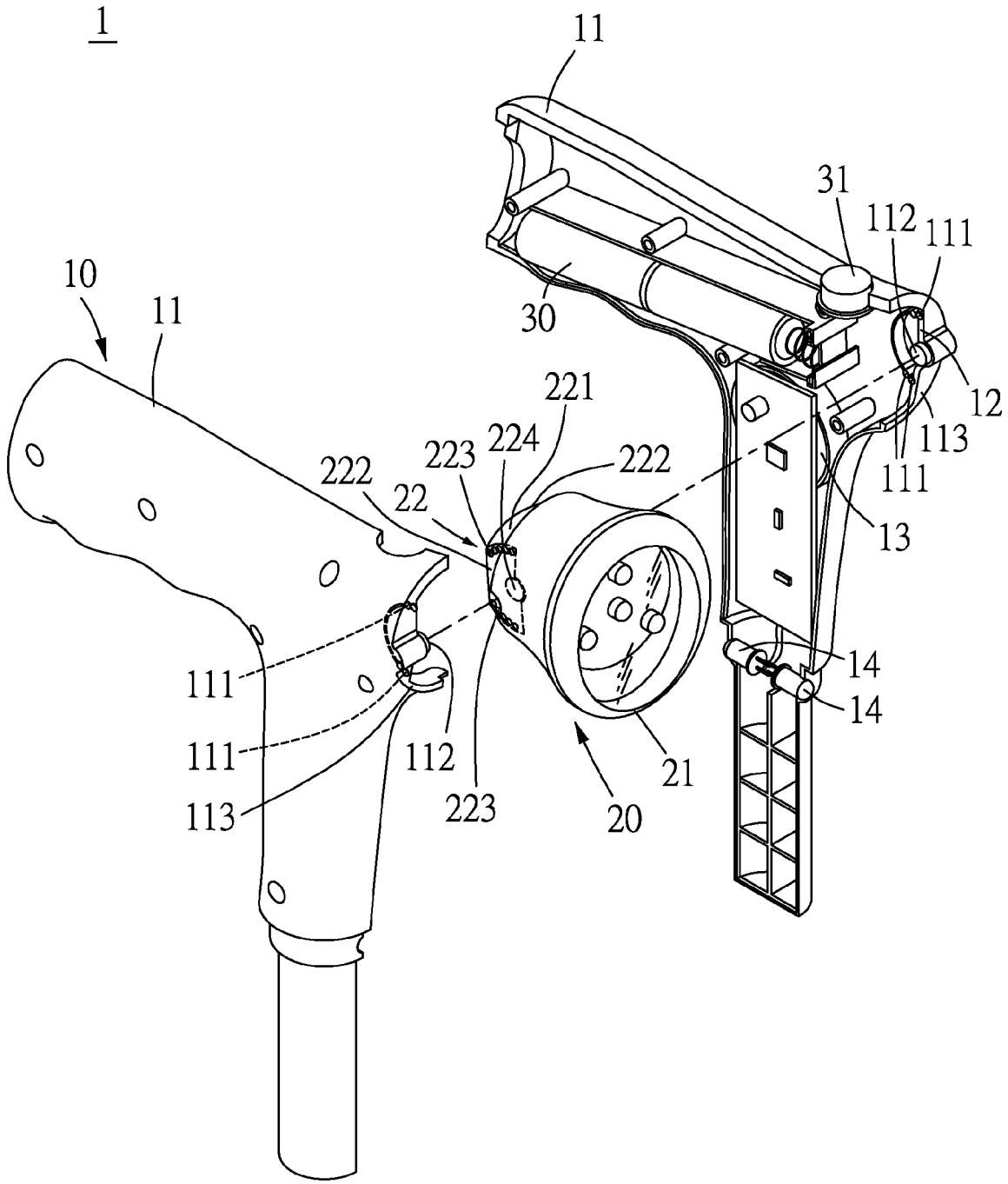
FIG. 1 is a schematic exploded view of a walking stick handle structure according to a specific embodiment of the present invention.
Figure 2:
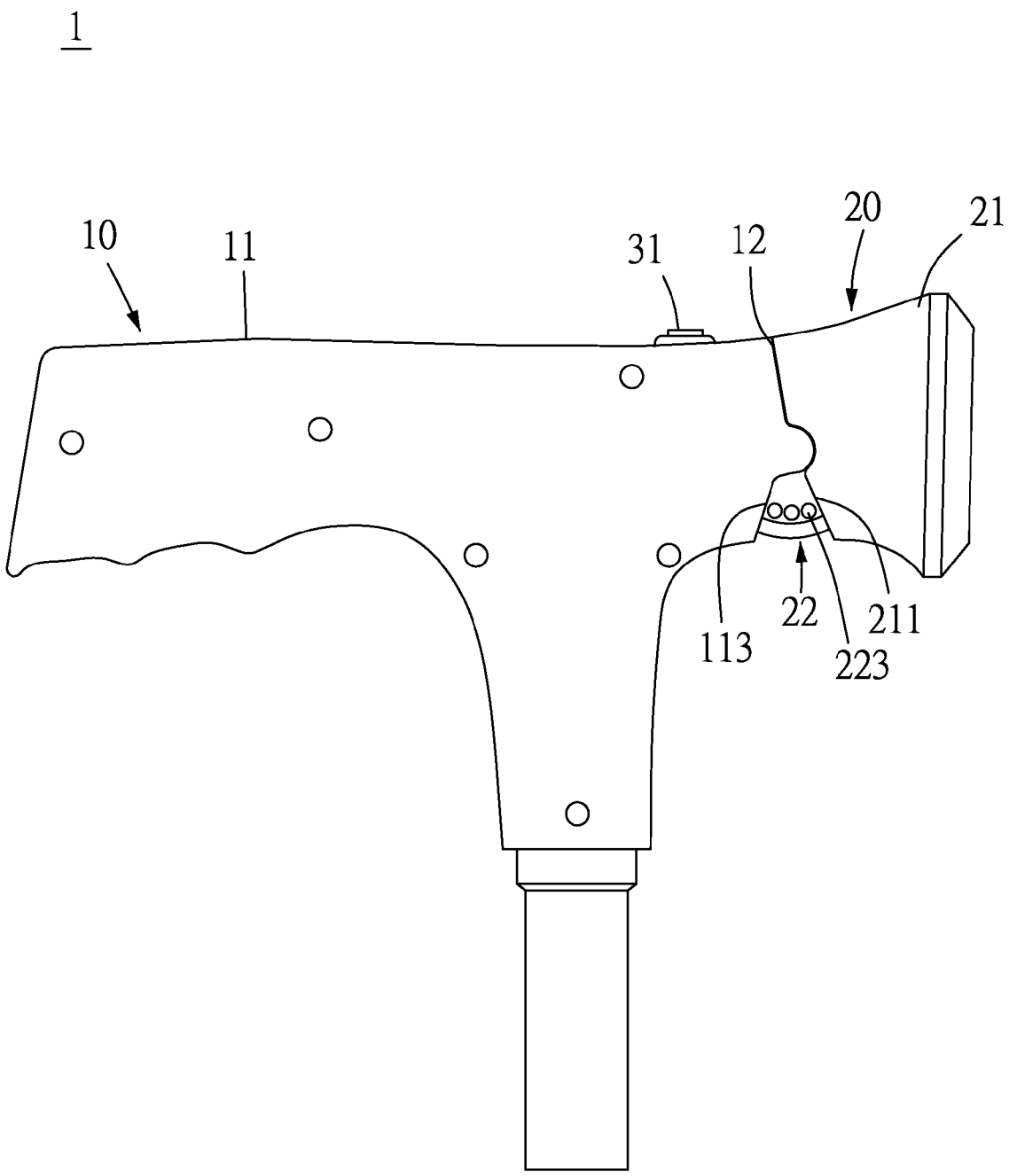
FIG. 2 is a schematic lateral view of the walking stick handle structure according to the specific embodiment of the present invention.

Referring to FIG. 1 and FIG. 2, there are shown a schematic exploded view and a schematic lateral view of a walking stick handle structure 1 according to a specific embodiment of the present invention, respectively. As shown in the diagrams, the walking stick handle structure 1 comprises a handle body 10, a light-emitting module 20, and a power module 30. The walking stick handle structure 1 is connected to a rod (not shown) from below to thereby form a walking stick.

The handle body 10 comprises two casings 11. The casings 11 are coupled together and form an opening 12 at one end of the handle body 10. A plurality of bumps 111 corresponding in position to the opening 12 is disposed on the inner wall of each of the casings 11.

The light-emitting module 20 comprises a first light-emitting portion 21 and a connection portion 22. The connection portion 22 is disposed in the opening 12 and pivotally connected to the casings 11 so as to be rotatable relative to the handle body 10. The connection portion 22 has a curved surface 221 and two lateral surfaces 222. The lateral surfaces 222 each have recesses 223 aligned in an arcuate pattern. The bumps 111 are engaged with the recesses 223 and fixed thereto, respectively, by the angle of rotation of the connection portion 22 relative to the handle body 10. With the recesses 223 being inside the opening 12, the bumps 111 engaged with and fixed to the recesses 223 are inside the opening 12 too.

The curved surface 221 of the connection portion 22 slides on the upper and lower portions of the inner rim of the opening 12, as soon as the light-emitting module 20 rotates relative to the handle body 10 through the connection portion 22.

The power module 30 is disposed in the handle body 10 and electrically connected to the first light-emitting portion 21. The power module 30 houses at least one battery (such as rechargeable battery and non-rechargeable battery) to supply power to the first light-emitting portion 21.

The first light-emitting portion 21 is equipped with a plurality of LED lamps. The power module 30 has a switch 31. The switch 31 is exposed from the handle body 10 and adapted to turn on or turn off the LED lamps of the first light-emitting portion 21, thereby providing illumination as needed.

The recesses 223 outnumber the bumps 111. The first light-emitting portion 21 can emit a light ray in a variable direction, because the angle of rotation of the connection portion 22 relative to the handle body 10 is variable. In this embodiment of the present invention, the variation of the angle of rotation of the connection portion 22 relative to the handle body 10 is further maintained, because not only can the bumps 111 be engaged with and fixed to the recesses 223, respectively, but the engaged pairs are variable by means of a reshuffle thereof.

In this embodiment, each of the lateral surfaces 222 of the connection portion 22 has a round hole 224. A post 112 is disposed on the inner wall of each of the casings 11 in the opening 12. The post 112 is inserted into the round hole 224 such that the connection portion 22 is rotatable about the post 112 to thereby change the direction of the light ray emitted from the first light-emitting portion 21. The recesses 223 on each of the lateral surfaces 222 of the connection portion 22 are aligned in an arcuate pattern whose virtual center is located at the round hole 224 exactly. With the recesses 223 being aligned in an arcuate pattern (as mentioned earlier), and the recesses 223 being corresponding in position to the bumps 111, respectively (as mentioned earlier), the bumps 111 are aligned in an arcuate pattern too.

To allow the light ray emitted from the light-emitting module 20 to propagate in a variable direction, for example, either forward or downward, while using the walking stick, the user rotates the light-emitting module 20 in a manner described below.

In this embodiment, the recesses 223 are positioned at upper and lower portions of each of the lateral surfaces 222, whereas the bumps 111 are positioned at upper and lower portions of the inner wall of each of the casings 11. The bumps 111 are engaged with and fixed to the recesses 223 positioned at upper and lower portions of each of the lateral surfaces 222 such that, upon an adjustment of the angle of rotation of the light-emitting module 20 to allow the light-emitting module 20 to be fixed at the handle body 10 by a new rotation angle, the light-emitting module 20 is prevented from rotating or sliding undesirably.

The way of varying the angle of rotation of the light-emitting module 20 relative to the handle body 10 can be varied, by increasing the quantity of the bumps 111 and the recesses 223 and/or changing the distance between the recesses 223. For example, by keeping the quantity of the bumps 111 unchanged and increasing the quantity of the recesses 223, it is possible to increase the maximum number of instances of varying the angle of rotation of the light-emitting module 20 relative to the handle body 10. For example, by increasing the distance between the recesses 223, it is possible to increase the change in the angle of rotation of the light-emitting module 20 relative to the handle body 10 in each instance of the variation of angle of rotation. Furthermore, a first tilted surface 211 is disposed at the junction of the first light-emitting portion 21 and the connection portion 22 and corresponds in position to the lower portion of each of the lateral surfaces 222. A second tilted surface 113 is disposed at the opening 12 and corresponds in position to the lower portion of the opening 12. Even if the external surface of the first light-emitting portion 21 of the light-emitting module 20 is flush with the external surface of the handle body 10, the light-emitting module 20 can still rotate relative to the handle body 10. Furthermore, the tilting angle of the first tilted surface 211 and the second tilted surface 113 corresponds in magnitude to the angle of rotation of the light-emitting module 20 relative to the handle body 10.

In this embodiment, for an illustrative purpose, five said recesses 223*a*, 223*b*, 223*c*, 223*d*, 223*e* are disposed at both the upper portion and the lower portion of each of the lateral surfaces 222, whereas two said bumps 111 are disposed at both the upper portion and the lower portion of the inner wall of each of the casings 11 in the opening 12. Upon the rotation of the connection portion 22 relative to the handle body 10, two said bumps 111 get engaged with and fixed to any two adjacent ones of the recesses 223*a*, 223*b*, 223*c*, 223*d*, 223*e*, such that the light ray emitted from the light-emitting module 20 can propagate in one of four different directions.

Figure 3:
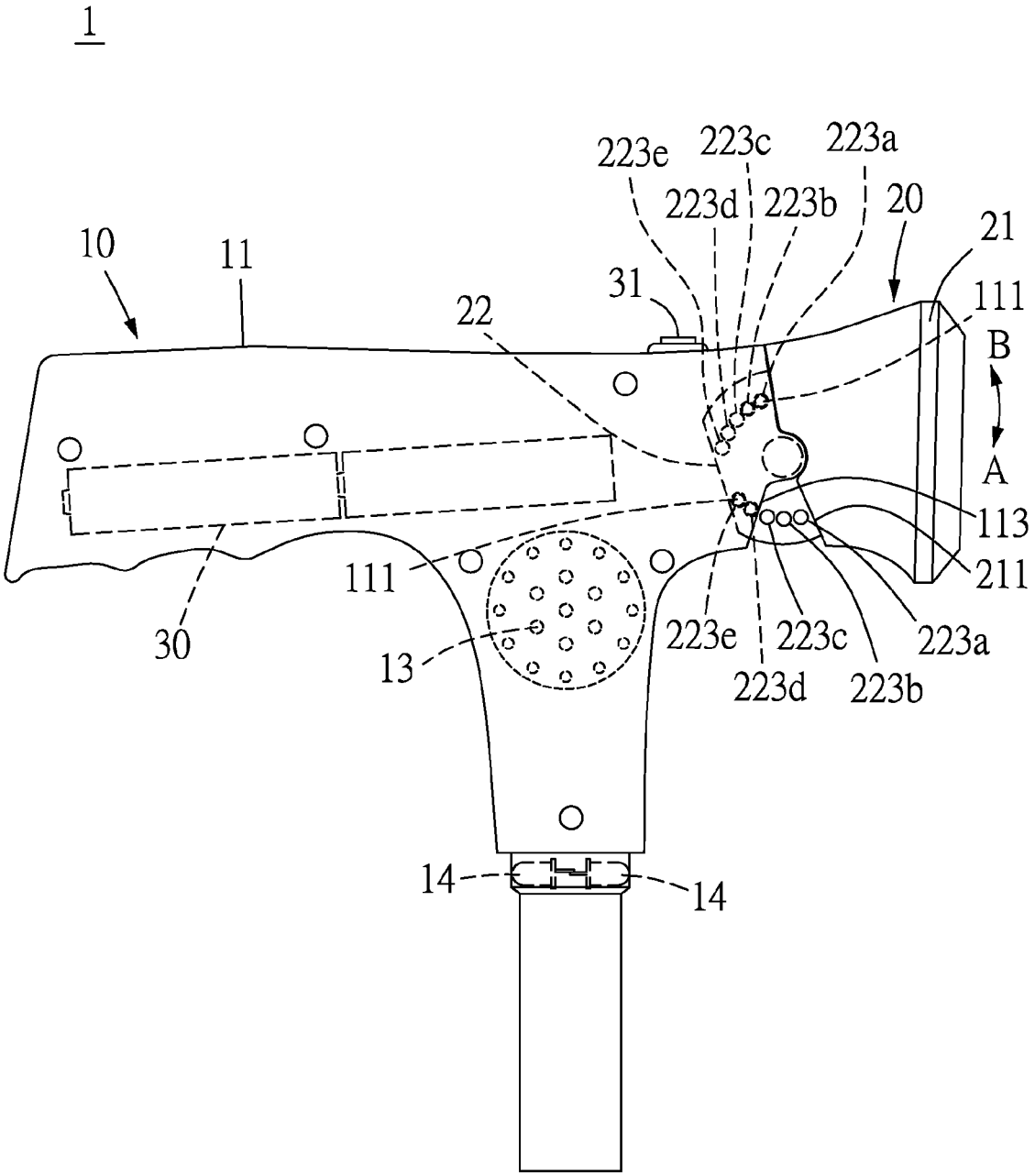
FIG. 3 is a schematic lateral view of the walking stick handle structure according to the specific embodiment of the present invention.

Referring to FIG. 3, the light ray (not shown) emitted from the first light-emitting portion 21 propagates in a forward direction (hereinafter referred to as the "first irradiation angle aspect"). The upper portion of the first light-emitting portion 21 of the light-emitting module 20 is engaged with the handle body 10. The lower portion of the first light-emitting portion 21 is spaced apart from the handle body 10 by a gap for exposing the three recesses 223*a*, 223*b*, 223*c* of the connection portion 22; in other words, between the first tilted surface 211 and the second tilted surface 113 is an included angle whereby the recesses 223*a*, 223*b*, 223*c* are exposed. The two bumps 111 at the upper portion of the inner wall of each of the casings 11 are engaged with and fixed to the recesses 223*a*, 223*b* disposed at the upper portion of the connection portion 22 and positioned most proximate to the first light-emitting portion 21. The two bumps 111 at the lower portion of the inner wall of each of the casings 11 are engaged with and fixed to the recesses 223*e*, 223*d* disposed at the lower portion of the connection portion 22 and positioned most distal to the first light-emitting portion 21.

Figure 4:
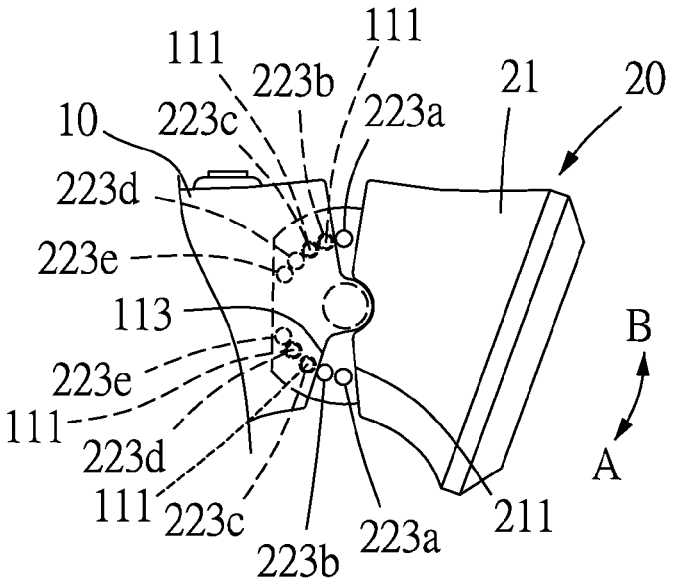
FIG. 4 is a schematic view of the walking stick handle structure according to the specific embodiment of the present invention.

Referring to FIG. 4, the light-emitting module 20 previously shown in FIG. 3 is rotated toward a direction A so as to emit a light ray (not shown) in the second irradiation angle aspect; meanwhile, the upper portion of the first light-emitting portion 21 of the light-emitting module 20 is spaced apart from the handle body 10 by a gap for exposing the recess 223*a* on the connection portion 22, whereas the lower portion of the first light-emitting portion 21 is spaced apart from the handle body 10 by a gap for exposing the two recesses 223*a*, 223*b* on the connection portion 22, that is to say, between the first tilted surface 211 and the second tilted surface 113 is an included angle whereby the recesses 223*a*, 223*b* are exposed. The two bumps 111 disposed at the upper portion of the inner wall of each of the casings 11 are engaged with and fixed to the recesses 223*b*, 223*c* disposed at the upper portion of the connection portion 22. The two bumps 111 disposed at the lower portion of the inner wall of each of the casings 11 are engaged with and fixed to the recesses 223*d*, 223*c* disposed at the lower portion of the connection portion 22.

Figure 5:
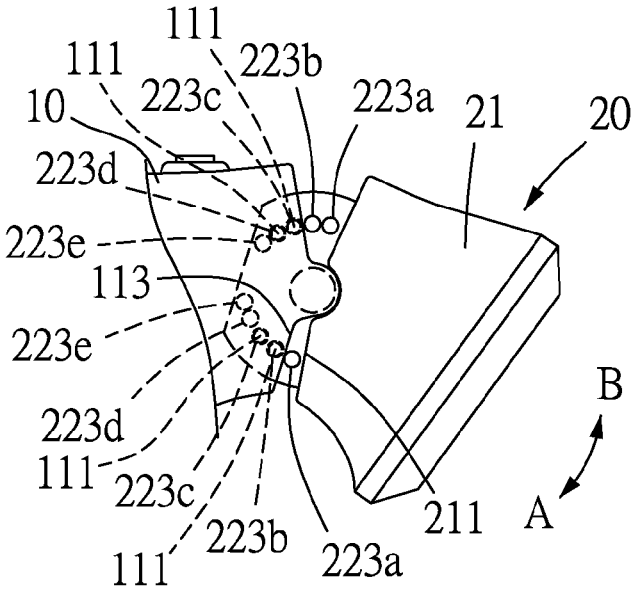
FIG. 5 is a schematic view of the walking stick handle structure according to the specific embodiment of the present invention.

Referring to FIG. 5, the light-emitting module 20 previously shown in FIG. 4 is rotated toward the direction A so as to emit a light ray (not shown) in the third irradiation angle aspect; meanwhile, the upper portion of the first light-emitting portion 21 of the light-emitting module 20 is spaced apart from the handle body 10 by a gap for exposing two recesses 223*a*, 223*b* on the connection portion 22, whereas the lower portion of the first light-emitting portion 21 is spaced apart from the handle body 10 by a gap for exposing the recess 223*a* on the connection portion 22, that is to say, between the first tilted surface 211 and the second tilted surface 113 is an included angle whereby the recess 223*a* is exposed. The two bumps 111 disposed at the upper portion of the inner wall of each of the casings 11 are engaged with and fixed to the recesses 223*c*, 223*d* on the connection portion 22. The two bumps 111 disposed at the lower portion of the inner wall of each of the casings 11 are engaged with and fixed to the recesses 223*c*, 223*b* disposed at the lower portion of the connection portion 22.

Figure 6:
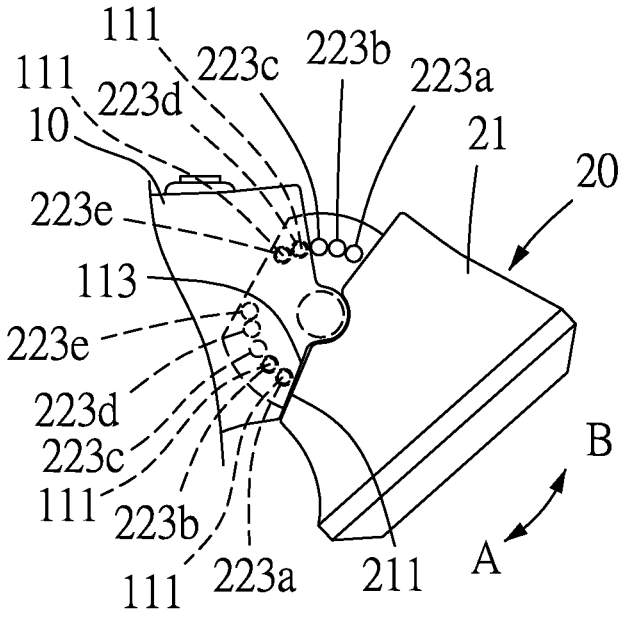
FIG. 6 is a schematic view of the walking stick handle structure according to the specific embodiment of the present invention.

Referring to FIG. 6, the light-emitting module 20 previously shown in FIG. 5 is rotated toward the direction A so as to emit a light ray (not shown) in the fourth irradiation angle aspect; meanwhile, the upper portion of the first light-emitting portion 21 of the light-emitting module 20 is spaced apart from the handle body 10 by a gap for exposing the three recesses 223*a*, 223*b*, 223*c* on the connection portion 22, whereas the lower portion of the first light-emitting portion 21 is engaged with the handle body 10, that is to say, the first tilted surface 211 and the second tilted surface 113 are engaged with each other. The two bumps 111 at the upper portion of the inner wall of each of the casings 11 are engaged with and fixed to the recesses 223*d*, 223*e* disposed at the upper portion of the connection portion 22 and positioned most distal to the first light-emitting portion 21. The two bumps 111 at the lower portion of the inner wall of each of the casings 11 are engaged with and fixed to the recesses 223*b*, 223*a* disposed at the lower portion of the connection portion 22 and positioned most proximate to the first light-emitting portion 21.

By contrast, if it is necessary for the first light-emitting portion 21 to emit a light ray (not shown) which propagates forward, the user can rotate the light-emitting module 20 toward a direction B to adjust the angle of rotation of the light-emitting module 20 relative to the handle body 10.

In this embodiment, the casings 11 are equipped with a buzzer 13. The buzzer 13 is electrically connected to the power module 30, such that the power module 30 supplies power to the buzzer 13 to enable the buzzer 13 to not only buzz but also to be turned on or turned off by the switch 31 or another switch, and in consequence the user in need of rescue or assistance can turn on the buzzer 13 to generate an alert signal for attracting attention from other people.

In this embodiment, the casings 11 has a second light-emitting portion 14. The second light-emitting portion 14 is electrically connected to the power module 30, such that the power module 30 supplies power to the second light-emitting portion 14 to light up an LED lamp on the second light-emitting portion 14. For an illustrative purpose, the second light-emitting portion 14 is disposed beneath the casings 11, and the second light-emitting portion 14 is turned on or turned off by the switch 31 or another switch. An LED lamp of a color, say, red, different from that of the first light-emitting portion 21 is installed on the second light-emitting portion 14. After being turned on, the second light-emitting portion 14 flashes to give an alert such that, in the dark, the other people notice the user, thereby preventing collision between the user and the other people.

Figure 7:
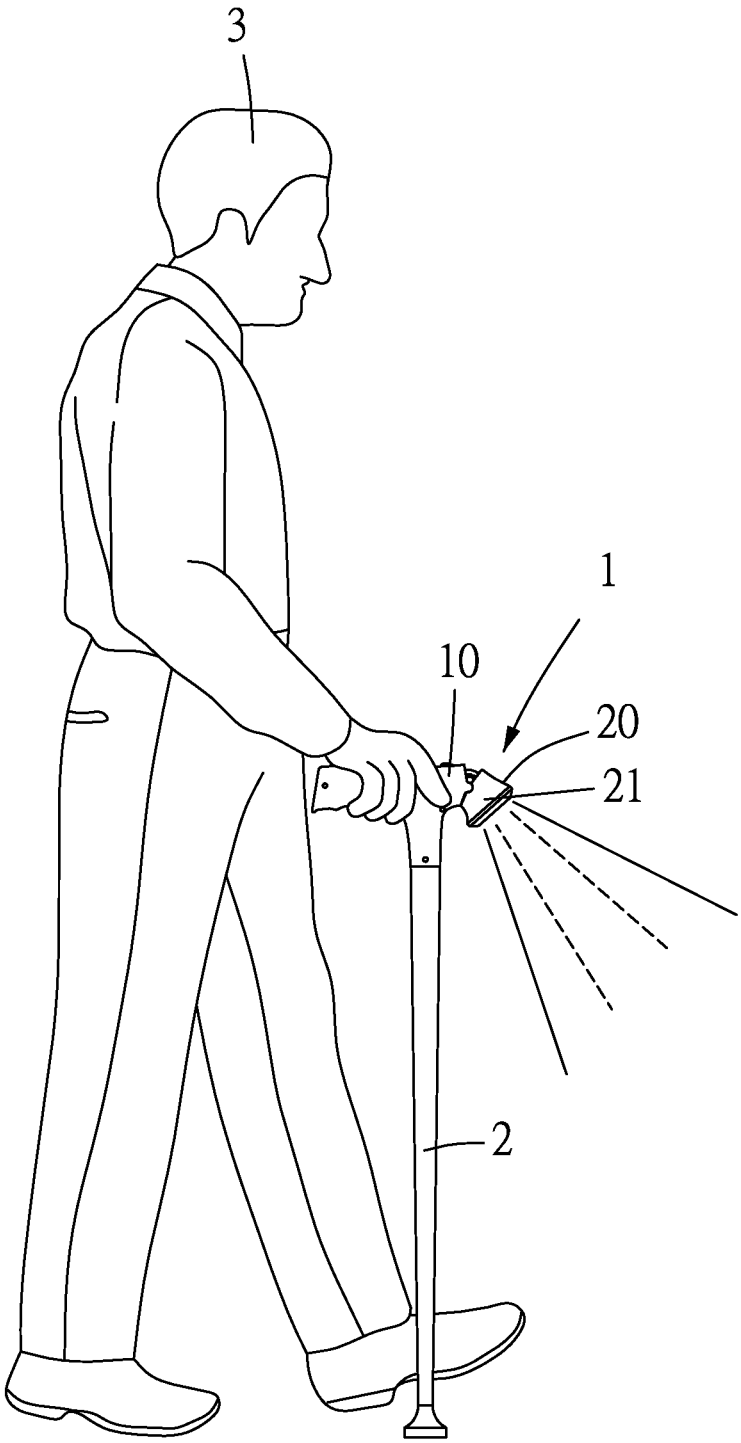
FIG. 7 is a schematic view of use of the walking stick handle structure according to the specific embodiment of the present invention.

Referring to FIG. 7, there is shown a schematic view of use of the walking stick handle structure 1 according to the specific embodiment of the present invention. As shown in the diagram, the walking stick handle structure 1 is coupled to a rod 2 from below to form a walking stick, and the rod 2 is capable of extension and retraction. While a user 3 is walking with the walking stick in the dark or at an unilluminated corner, the user 3 grips the walking stick handle structure 1 such that the walking stick bears a portion of the body weight of the user 3; meanwhile, to meet his or her need of continuous illumination, the user 3 rotates the light-emitting module 20 relative to the handle body 10 to adjust the direction in which the light ray emitted from the first light-emitting portion 21 propagates until the light ray falls on the ground immediately in front of the user 3. At this point in time, the user 3 begins to walk and thus, during the walk, the ground immediately in front of the user 3 is continuously illuminated while the user 3 is walking with the walking stick, thereby enhancing user safety.

In conclusion, a walking stick handle structure of the present invention is characterized in that: a light-emitting module is pivotally coupled to a handle body by means of a connection portion; the light-emitting module can be rotated relative to the handle body; and recesses on the connection portion and bumps on the handle body are engaged with each other, respectively, to fix the angle of rotation of the light-emitting module relative to the handle body, so as to enable the user to adjust the direction in which a light ray emitted from the light-emitting module propagates and thus provide continuous illumination, thereby enhancing user safety.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A walking stick handle structure, comprising:

a handle body comprising two casings coupled together to form an opening at an end of the handle body, the two casings each having an inner wall disposed thereon with a plurality of bumps corresponding in position to the opening;

a light-emitting module comprising a first light-emitting portion and a connection portion, the connection portion being disposed in the opening and pivotally connected to the two casings to enable the connection portion to rotate relative to the handle body, the connection portion having a curved surface and two lateral surfaces, the two lateral surfaces each having recesses aligned in an arcuate pattern, and the plurality of bumps being engaged with and fixed to the recesses, respectively, by an angle of rotation of the connection portion relative to the handle body; and a power module disposed in the handle body and electrically connected to the first light-emitting portion;

wherein five of the recesses are disposed at both an upper portion and a lower portion of each of the two lateral surfaces, and two of the plurality of bumps are disposed at both the upper portion and the lower portion of the inner wall of each of the two casings in the opening and engaged with and fixed to any two adjacent ones of the recesses upon rotation of the connection portion relative to the handle body, wherein a first tilted surface is disposed at a junction of the first light-emitting portion and the connection portion and corresponds in position to a lower portion of each of the two lateral surfaces, wherein a second tilted surface is disposed at the opening and corresponds in position to a lower portion of the opening.

2. The walking stick handle structure of claim 1, wherein each of the lateral surfaces of the connection portion has a round hole, and a post is disposed on the inner wall of each of the casings in the opening and inserted into the round hole.

3. The walking stick handle structure of claim 1, wherein the casings are equipped with a buzzer electrically connected to the power module.

4. The walking stick handle structure of claim 1, wherein the casings are equipped with a second light-emitting portion electrically connected to the power module.

* * * * *